United States Patent [19]

Cohen

[11] Patent Number: 4,739,318

[45] Date of Patent: Apr. 19, 1988

[54] VISUAL DISPLAY SYSTEM FOR USE WITH IDEOGRAPHIC LANGUAGES

[75] Inventor: James A. Cohen, Fairfield, Iowa

[73] Assignee: Global Integration Technologies, Inc., Fairfield, Iowa

[21] Appl. No.: 573,131

[22] Filed: Jan. 23, 1984

[51] Int. Cl.[4] ..... G09G 1/00

[52] U.S. Cl. ..... 340/750; 340/751; 340/709

[58] Field of Search ..... 340/751, 731, 734, 739, 340/790, 735, 709, 802, 723

[56] References Cited

U.S. PATENT DOCUMENTS

| | | | |
|---|---|---|---|
| 3,505,665 | 4/1970 | Lasoff et al. | 340/739 |
| 3,566,361 | 2/1971 | Lavertu et al. | 340/734 |
| 4,144,405 | 3/1979 | Wakamatsu | 340/751 |
| 4,228,430 | 10/1980 | Iwamura et al. | 340/735 |
| 4,408,199 | 10/1983 | White et al. | 340/731 |
| 4,419,661 | 12/1983 | Hetsugi | 340/751 |
| 4,511,267 | 4/1985 | Pokorny | 340/751 |

*Primary Examiner*—Marshall M. Curtis

*Attorney, Agent, or Firm*—Phillips, Moore, Lempio & Finley

[57] ABSTRACT

A visual display system adapted for a cathode ray tube or a liquid crystal display that shows the construction of a composite ideographic character. The system displays the root ideograms as they are keyed-in in an "n×m" pixel area and simultaneously highlights a "u×v" portion of the "n×m" pixel area in which the next operation is to take place, the next operation being either the construction of a root having dimensions equal to "u×v" or a further division of the "u×v" area.

6 Claims, 8 Drawing Sheets

Microfiche Appendix Included
(19 Microfiche, 1 Pages)

FIGURE 1
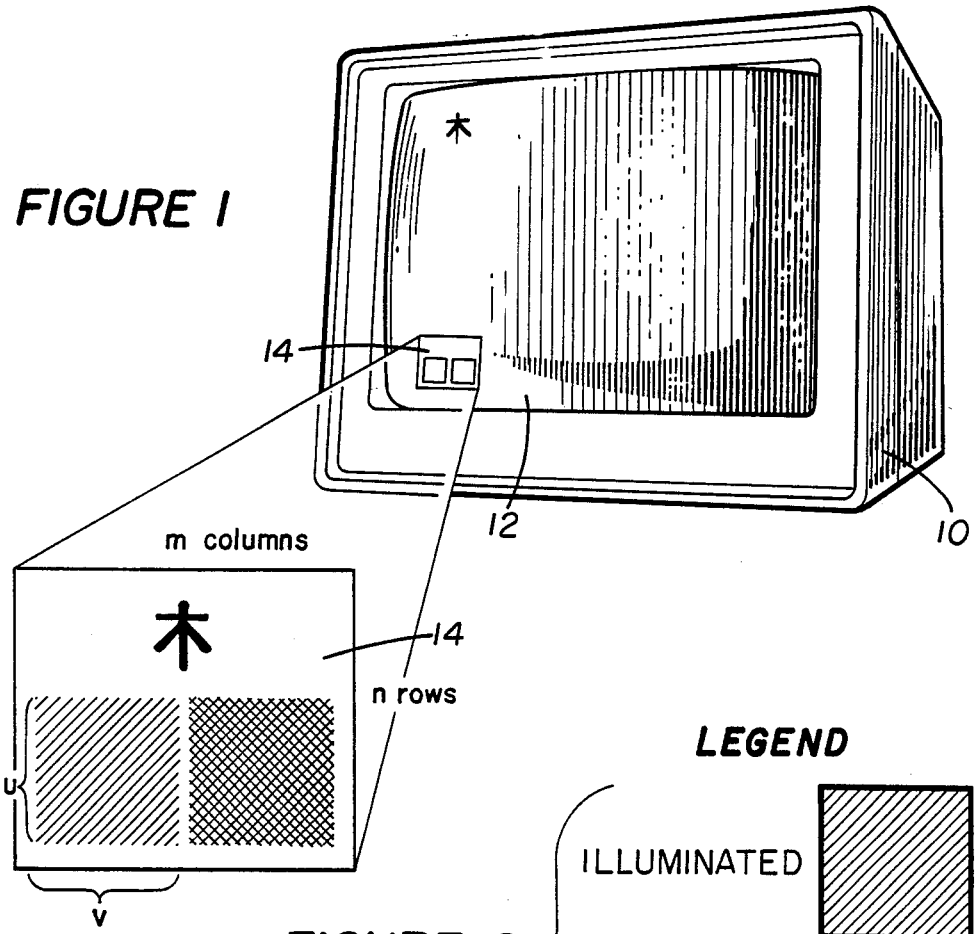
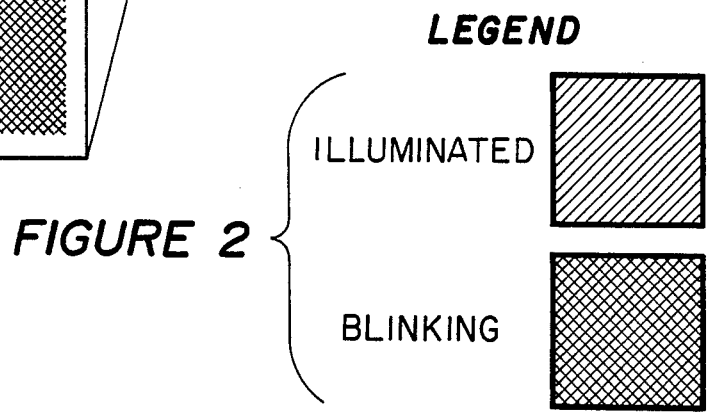
FIGURE 2
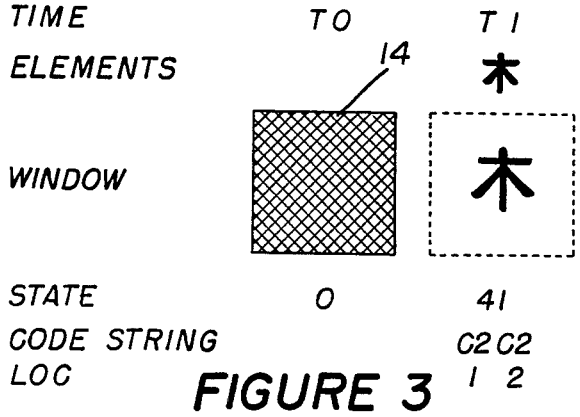
FIGURE 3

VISUAL DISPLAY SYSTEM FOR USE WITH IDEOGRAPHIC LANGUAGES

A microfiche with nineteen frames of a representative computer program is appended.

TECHNICAL FIELD

This invention relates to the generation of two-dimensional characters in an ideographic language by a computer system. In particular, it relates to the display of the ideographic character as character construction is developed using one or more root ideograms. Simultaneously, the display system highlights the next area in which the one or more root ideograms are to be placed.

BACKGROUND ART

The current language systems include those having finite alphabet sets, such as Roman or English, Hebrew, Arabic, Greek, or Russian. The other widely-used written form of communication consists of an ideographic character set used by the Chinese, Japanese, and Korean-speaking people. As is well known, ideographic character sets, and in particular the Oriental set, are open-ended, since each ideogram may be composed of one or more root ideograms. It is estimated that the classical Chinese character set has in excess of sixty thousand different characters.

It is to be understood, for purposes of this invention, that the word "ideogram" is used to generically described the pictograms representing, albeit somewhat fancifully, the item being described, the composite pictogram consisting of two or more pictograms or two other ideograms, and finally the third generalized form of an ideogram. This third generalized form is comprised of a radical or root component which indicates the general semantic character of the word, for example, a plant, a tree, or a bird, and a phonogram or phonetic component that indicates the general pronunciation of the word and thereby specifies which member of the generic character is being represented. For example, if one looks at various types of birds, such as the oriole, the chicken, or the seagull, the root component for a bird is found in each case.

Generally speaking, all ideographic characters, whether they are a single ideogram or a composite ideogram, are substantially the same size. This requires the root ideograms that make up a composite ideogram to be compressed in size, either by narrowing the vertical or horizontal dimension, or by a general overall compression. It is important that, during the size reduction, intelligence contained in the character is not lost. Portions of the character such as serifs may contain important information, and by eliminating a serif, the entire meaning of the character can be changed.

An ideogram generator that accomplishes the compression of ideographic root characters without losing intelligence is disclosed in U.S. Pat. No. 4,408,199 issued Oct. 4, 1983 to Douglass A. White, Susan J. Moore, and David F. Clark and assigned to the assignee of this invention.

While the ideogram generator disclosed in the aforesaid patent surpasses the capability of previously-developed automated ideographic typing systems, both in number of keystroke per character and in versatility, it does not provide to the user an intermediate view of the composite ideogram being developed. Other ideographic word processors or typing systems also provide only the finished character or the components. For example, if the composite ideogram is composed of three root ideograms with one root ideogram disposed above the other two ideograms which are in themselves disposed side by side, the user must envision positioning and the final structure of the ideogram in order to properly key in the desired composite ideogram. If the user makes a mistake, either in keying in the shape operators that reduce the size of the root ideograms, or in keying in the root ideograms themselves, this is not discovered until the entire series of coded strings have been entered into the system. As a result, the developed character may be improperly compressed or alternatively, be comprises of the wrong root ideograms. It should be apparent that this "misspelling" results in a complete erasure and reconstruction of the desired composite ideogram.

A second shortcoming of existing ideogram generators is the failure to take into account the natural order of writing used in Oriental ideographic character sets. Specifically, one writes from the top down and from the left to the right, and from the outside to the inside. While this can be simulated in the aforedescribed patent, the "feel" and "see" that corresponds to the hand construction of ideographic characters is missing. In the aforedescribed reference, the character, while it may be constructed in the order just denoted and may be displayed component by component, magically appears in its developed form once the last series of coded characters is entered and a delimiter is indicated to show the end of the character. As previously noted, if a mistake is entered during the construction of the character, this may not be determined until the final result of the character is displayed, either on the screen or the printer.

Since it is known that the ideographic character set used by the Chinese, Japanese, and Koreans may be broken down into a workable number of root components such as is shown in U.S. Pat. No. 4,408,199, it would be appropriate to provide a display system that permits viewing of the composite character as it is constructed by the user so that, not only will the user view the elements of the composite character as it is being constructed, but further will get a feel for the natural method of writing in an ideographic character set.

DISCLOSURE OF THE INVENTION

In one aspect of this invention, a visual display system for use with an ideographic language is disclosed where each character of the language is formed of one or more root ideograms and further where each composite character so formed occupies the same space as a single root ideogram, with each root ideogram being reduced in size by one of several shape operators, and further wherein a composite character has at least one shape operator and at least two root ideograms. The display system includes an input device for accepting a series of coded strings representing root ideograms and shape operators. A computer program is utilized to determine whether each of the inputted series of coded character strings represents a root ideogram or a shape operator. A display device is included for displaying in an "n×m" pixel area the root ideograms as they are accepted by the input device and after being reduced in size by the shape operator. Finally, the display device and programming provides for highlighting the "n−r" by "m−s" space not occupied by the first root ideogram.

Also included is a method for inputting a character string into a display system that includes the steps of accepting a series of codes, each code denoting either an ideogram or a shape operator. Also included are the steps of displaying after accepting each code the intermediate structure of the composite ideogram in a given space; highlighting after accepting each code on the display tube the next operable area in the given space in which an operation may occur; and repeating the second and third steps as each code is accepted until the composite ideogram is constructed.

This invention overcomes the shortcomings of previous ideogram generators in that actual construction of the ideogram is displayed during the process of code entry by the operator.

BRIEF DESCRIPTION OF THE DRAWINGS

FIG. 1 is a schematic of a video display terminal on which the character being generated may be displayed showing the preferred positioning of the cursor.

FIG. 2 is a legend of the descriptions of various usages shown in FIGS. 3, 4, 5, 6, 7 and 8.

FIGS. 3 through 8 illustrate various different examples of the construction of ideographic characters of differing complexity.

DETAILED DESCRIPTION OF THE PREFERRED EMBODIMENT

In FIG. 1, a video display terminal 10 is illustrated having a cathode ray tube. As is usual in video display terminals, a supervisory program associated with a computer (not shown) will cause a cursor 14 to be displayed somewhere on the surface of the cathode ray tube. Cursor 14 may take the characteristic of a horizontal line or dash or in the example shown in FIG. 1 an "illuminated" rectangle or box. Associated supervisory programs will then cause the box 14 to be highlighted or illuminated on the surface of the cathode ray tube 12 so that the user will know that the next character or operation to be performed will occur at cursor 14. In FIG. 1, cursor 14 is shown expanded and off the screen. As is usual in video display terminals, cursor 14 will occupy a certain space on the surface of the cathode ray tube determined by the resolution of the set. This space can be defined in rows and columns of pixels with each pixel being the smallest unit of intelligence that may be displayed on the terminal. In the particular application herein described, it will be assumed that there are "n" rows and "m" columns of pixels. In certain microcomputer applications such as the Apple II, a pixel can be likened to the dots that form readable or understandable material on the screen. Thus, twenty-four lines of text with forty characters in each line using a five by seven dot matrix for each character results in a possibility of 33,600 dots or pixels on the surface of the screen.

In U.S. Pat. No. 4,408,199 a twenty-one by twenty-one dot matrix was used to construct the characters in that ideogram generator. It should be noted that the matrix need not be square in either this application or in application of the teachings of the U.S. Pat. No. 4,408,199 reference.

Referring still to FIG. 1, it can be seen that the expanded cursor 14 is divided into three segments, the upper segment having a character or an ideogram depicted thereon while the lower left-hand segment has hash marks with the lower right-hand segment being cross-hatched. This hatching and cross-hatching is described in the legend shown in FIG. 2.

Figure 8:
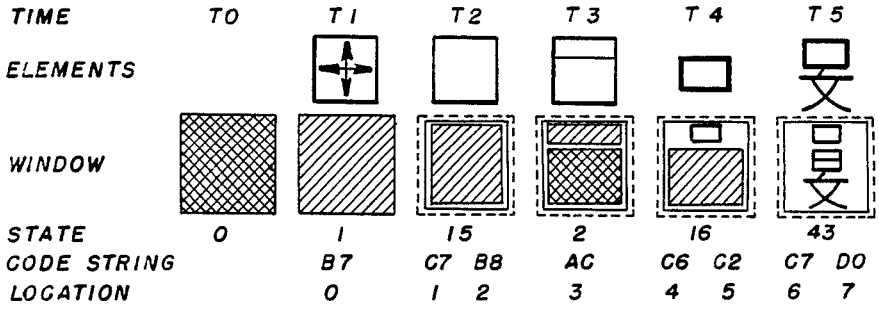
Figure 9:
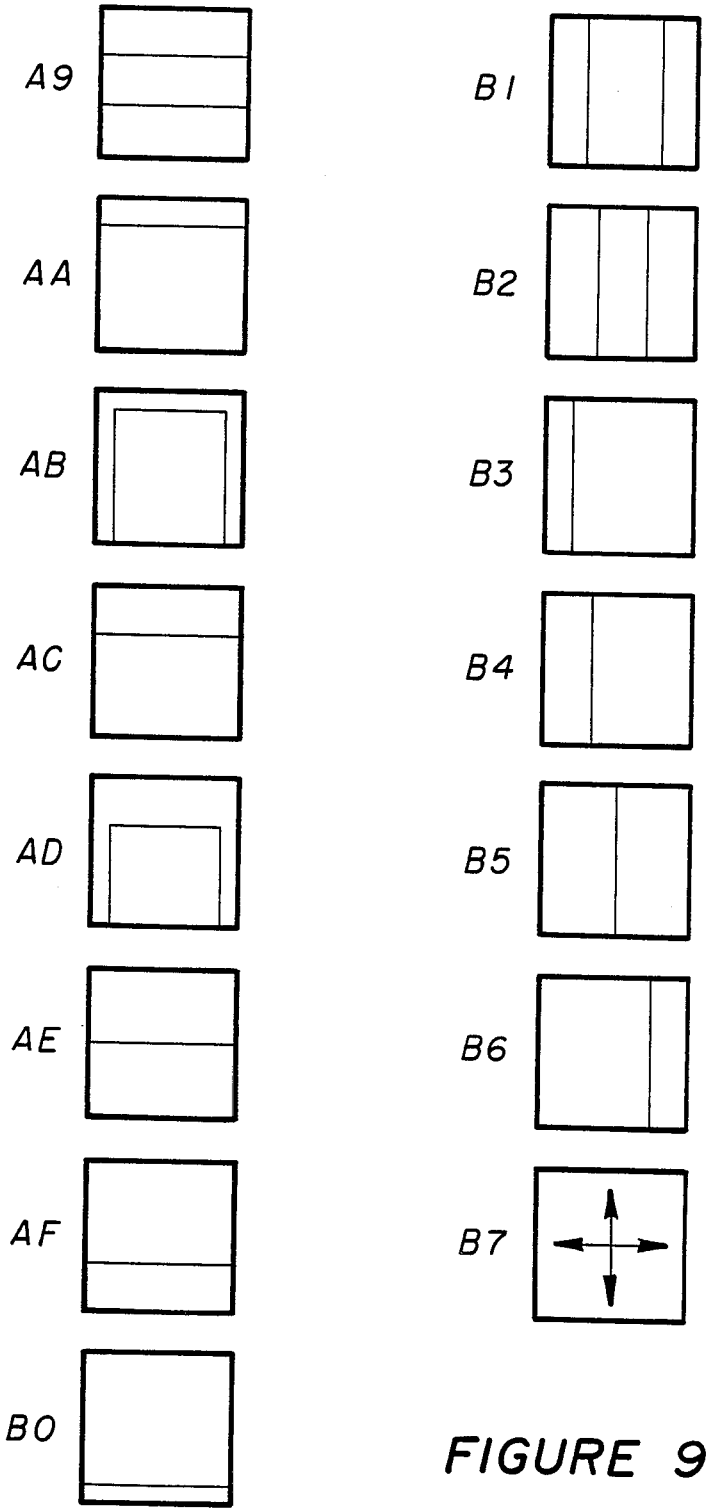
FIG. 9 illustrates the various shape operators that may be used in operating this system.

An ideogram character set such as the Chinese, Japanese, or Korean set can generally be divided into certain discrete elements that form a set smaller than the character set utilized by the particular language. For example, the classical Chinese set may include in excess of 60,000 characters. These 60,000 characters, however, may be broken down into a workable number of about 1400 to 1500. An example of such an elementary character set is shown in Appendix 1 of U.S. Pat. No. 4,408,199. The invention disclosed may herein use a similar character set which includes about 1300 characters. Each of the characters in the basic, fundamental character set is denoted by two eight-bit bytes. An example is shown in FIG. 3 of this invention wherein the code string for the character in FIG. 3 is indicated as hexidecimal C2C2. The particular character represented by C2C2 means "tree". In FIG. 3 and in the subsequent FIGS. 4, 5, 6, 7 and 8, there is an indication across the top of time T0, T1 and so on. This indication is relative only and indicates the next sequential timed operation. The second line in each of the Figures is an indication of the keyed operation. Certain operations will be called shape operations and these are depicted in FIG. 9. As can be seen in FIG. 9, there are various breakdowns of the cursor, for example, the shape operation A9 divides the screen into three horizontal bands, while the shape operation B2 divides the cursor into three vertical bands. Shape operation AB and AD divide the screen as indicated in FIG. 6, while shape operator B7 provides a frame around a smaller portion of the cursor. This is illustrated in FIG. 8. The use of these shape operators with character strings is described in U.S. Pat. No. 4,408,199 wherein an extensive description of the generation of ideograms from various keystrokes is described.

As can be seen in FIG. 3, the cursor 14 with no code string present is fully illuminated. If the hexidecimal code string C2C2 is received and operated upon by the program (to be described), the character represented by the code string C2C2 will appear in the cursor as shown in the right-hand portion of FIG. 3. When the user is satisfied, that element may be moved to the upper portion of the screen as shown in FIG. 1, wherein the character for "tree" is in the upper left-hand corner of the screen. This is the simplest representation that takes place in this display operation since only the base or root ideogram is used.

Figure 4:
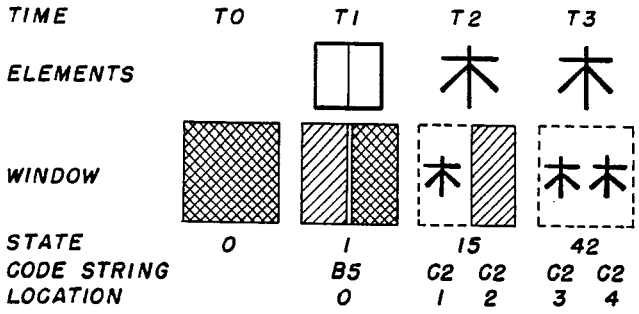

In FIG. 4, the cursor 14 is first divided in half by utilizing shape operator B5 illustrated in FIG. 9. It should be understood that the character strings for the shape operators are reserved characters as will be described subsequently. Following the division of the cursor 14 as shown in FIG. 4, two series of coded strings C2C2 and C2C2 are keyed in. This forms the Oriental character that represents the word "grove" for a grove of trees. In FIG. 4, at time T1, it can be seen that the left-hand portion of the cursor is blinking while the right-hand portion is permanently illuminated. The indication of the blinking cursor means that the next operation will be performed on the left-hand side of the cursor, as reflected by the appearance of the character for "tree" at time T2 once the strokes of the character string C2C2 have been accepted by the associated ideogram generator. At this time, the right-hand side of the screen blinks, permitting the second ideogram for "tree" to be keyed in so that the finished character for the word "groove" is located in the cursor window.

Figure 5:
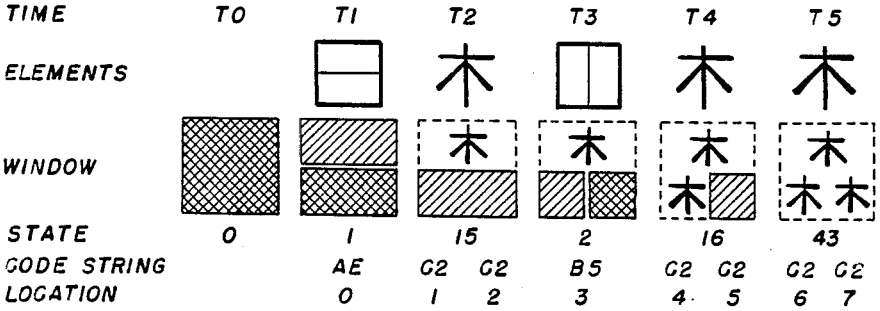
Figure 6:
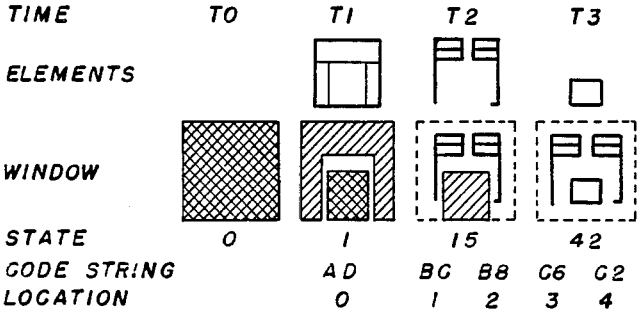

In FIG. 5, the character representing the word for "forest" is shown. As can be seen, "forest" is composed of three characters for "tree". In this example, the screen is first divided in half horizontally by using the shape operator AE at time T1 with the upper half of the screen or cursor blinking to indicate that the character or operation to be performed at time T2 will occur in the upper half of the cursor. Again, the coded string C2C2 is entered with the character for "tree" appearing in the upper half of the cursor. Following the entry of the character for "tree" the lower half of the cursor blinks, indicating the next operation will occur on the lower half. Since two additional characters for "tree" must be utilized, a second shape operator B5 is then entered, dividing the lower half of the cursor into right and left portions with the left portion blinking. At time T4 and T5, respectively, the coded strings C2C2 and C2C2 are entered so that the character representing the word for "forest" is developed. The illustration shown in FIG. 5 shows how the ordinary Oriental character is written specifically from the top down and from the left to the right. Thus, if an Oriental was writing the character for "forest", he would follow the same sequence shown in time slots T2, T4 and T5. In this invention, the character is developed on the screen in that same sequence as shown in FIG. 5, and in the same space.

FIG. 6 illustrates the principle of developing the character from the outside inwardly. In FIG. 6 at time T1, the shape operator AD is utilized first to provide a blinking table-like opening over the top of the illuminated block in the lower half of the cursor. At time T2, the character for "door" which is shown in the element line at FIG. 6 is entered. Once this character is entered, the cube-like portion of the cursor shown in the lower half begins to blink so that the operator can key in the character for "mouth" shown at time T3 of FIG. 6. The combination of the character for "mouth" and the character for "door" forms the Oriental work for "ask".

Figure 7:
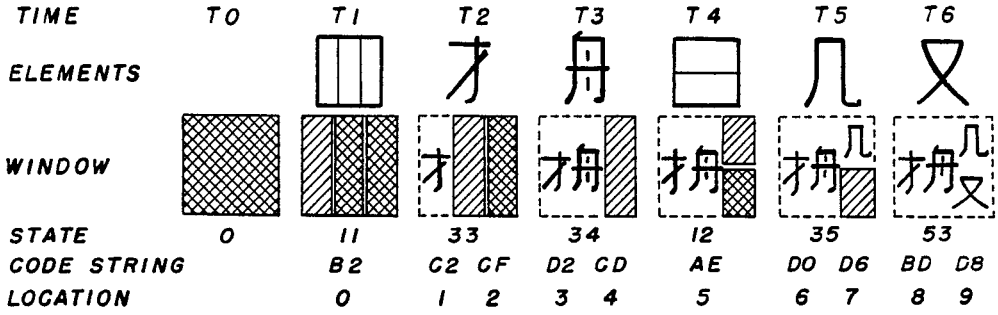

In FIG. 7, the construction of the character for "carry" is shown. In the FIG. 7 illustration, it can be seen that two shape operators are utilized, interspersed with four character strings to form the word meaning "to carry". Initially, the cursor is divided into three portions as is shown at time T1 utilizing the shape operator code string B2 which results in the left-hand portion of the divided cursor blinking with the center and right-hand portions going full illumination. It should be noted that, when the cursor is divided by a shape operator as shown in time T1 in FIG. 7 (and as also indicated in FIGS. 4, 5, 6 and 8), it is appropriate to leave a separation between the various portions of the divided cursor so that the user is aware of what has taken place. It is possible that in a multi-colored cathode ray tube, the three portions could take on different colors. However, in the black and white environment, or monochrome screen, it is necessary to blink one portion and to provide division lines. At time T2, the character for "hand" represented by the character string C2CF is entered in the left-hand portion of the cursor window, which results in the center portion blinking and the right-hand portion remaining fully illuminated. This is followed by the entry of the character for "boat" represented by the character string D2CD in the center portion. At this point, the third segment on the right-hand side of the cursor is divided again by using the character string AE which represents the shape operator to divide the unused cursor. It should be noted that this shape operator AE is the same shape operator used in the illustration shown in FIG. 5 to divide the entire screen. This is followed by the character for "table" which takes the upper portion of the right-hand side of the screen as represented by the character string D0D6. Finally, the character for grasping represented by the character BDD8 is inserted in the lower right-hand portion of the cursor so that the ideogram "to carry" has been formed from four separate root ideograms arranged in the manner shown in FIG. 7. Again, it can be seen that the conventional left to right and top to bottom order of construction has been utilized in forming this character.

Finally, in FIG. 8, the character for "round" is formed by the combination of the ideogram for "enclose" represented by the character string C7B8 being used to surround the blinking cursor as is represented at time T2 in FIG. 8. The shape operator AC is then keyed in to divide the space inside of the character C7B8, which is the character for "enclose". Shape operator AC divides the inner space into an upper and lower portion so that the character for "mouth" which is C6C2 may be placed in the upper portion and the character for "shell" C7D0 may be placed in the lower portion, thus forming the Chinese ideogram meaning "round".

These examples have been discussed in detail so that it is readily apparent what the invention is, specifically, that the display or cursor window as shown in FIG. 1 may be divided into various portions to enable insertion of reduced characters in those portions to form a composite ideogram in the manner of conventional writing.

Figure 10:
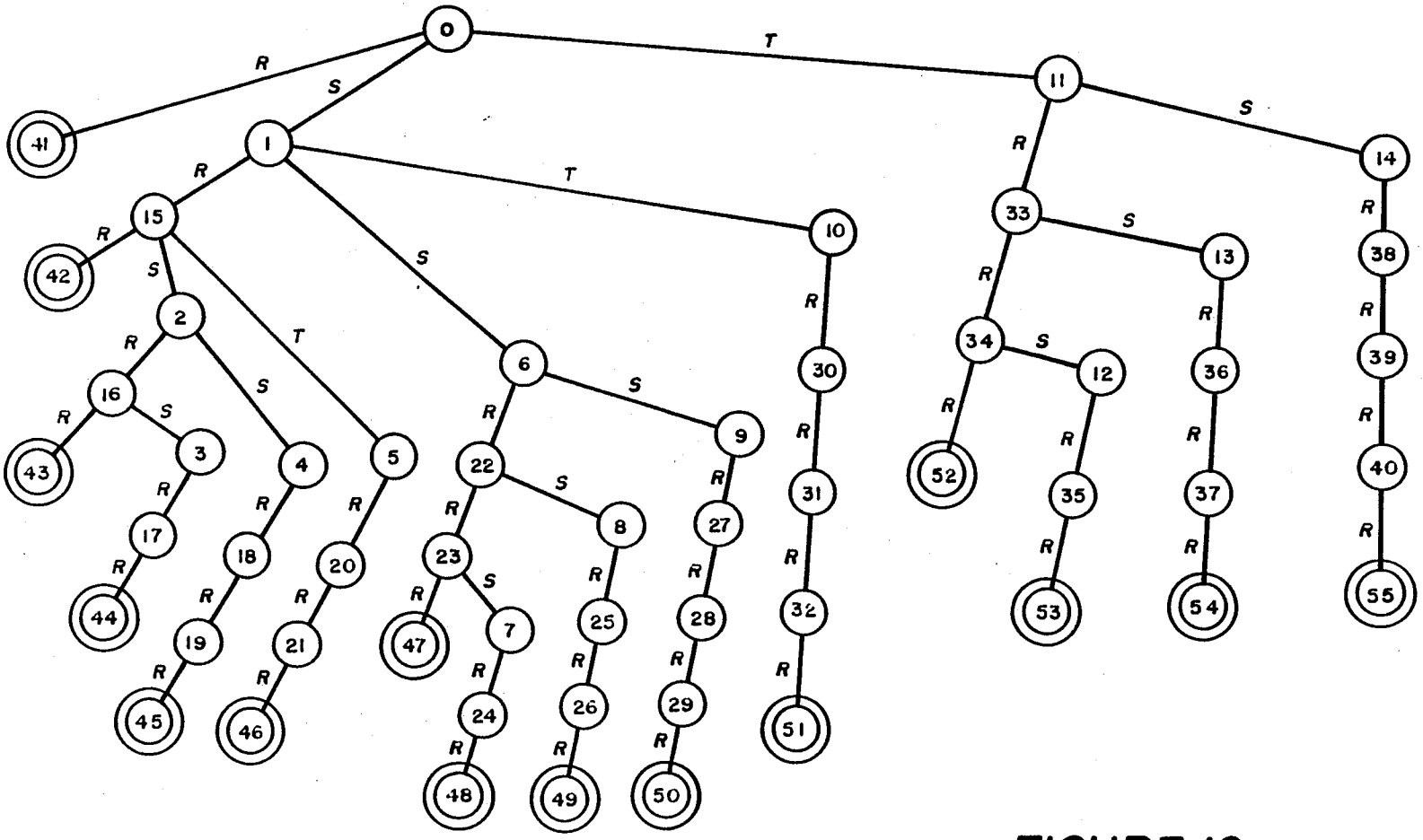
FIG. 10 is a syntax table used by the system.

It can be seen from the examples set forth above for each shape operator there always exists at least two character strings following the use of the shape operator. In some instances, there may be three strings representing ideograms following the shape operator. This syntax is illustrated in FIG. 10 where the possibilities available to one using the shape operators shown in FIG. 9 are broken into a syntax tree with time T0 represented at the zero node or "state 0" in the upper portion of FIG. 10. This syntax tree is used in the associated program to ensure that the character chain is a valid character chain and to determine the next and preceding states. Should the character chain not be valid, an error message would be flashed on the screen and the cursor window returned to the previous state that existed before the error recurred.

Still referring to FIG. 10, it can be seen that from time T0 or state 0, the user has the choice of entering either a root represented by an "r" or a shape represented by an "s" that divides the cursor window into two portions or a "t" which represents division of the window into three portions, such as would occur by the use of shape operator A9, B1 or B2. The tree illustrated in FIG. 10 permits a continuous check on the syntax of the entered character string. The numbers are chosen at the particular nodes to facilitate this syntax check. Examination of FIG. 10 will indicate that the final states which are at the end of the branches are represented by numbers greater than or equal to 41.

It can be seen that, with the tree structure shown in FIG. 10, the syntax or makeup of the character string may be readily checked. It should be remembered that, in this particular application, a shape operator is represented by an eight-bit byte having a value less than a hexidecimal B7 while character strings representing root ideograms are formed pairs of hexidecimal strings each of which is greater than hexidecimal B7. It should be understood that the hexidecimal value of B7 was chosen in this particular application and should not be considered limiting, the only limitation being that logic requires separation of the shape operators from character strings representing root ideograms. The syntax tree set forth in FIG. 1 is easily adapted to a table form to permit the selection of the next root state, the next paired shape operator, or the next tripled shape operator. Thus, for state 0 the next root is state 41, the next paired shape operator is 1 and the next tripled shape operator is 11. Conversely, when one finds oneself in state 1 the previous state is state 0 since each node has only one entry point and no more than three exit points. For example, if one were in state 1, the only valid selections are a triplet shape operator which would divide either the left portion of the cursor window or the upper portion, depending upon the original shape operator selected at the first step, and thus resulting in state 10. A paired shape operator, performing the same function, results in state 6. The entry of a root that would then be displayed on either the left or the upper portion of the cursor window, as the case may be, results in state 15.

It can be seen from a close inspection of the syntax tree shown in FIG. 10 what the principal advantages of this invention are. First, the actual construction of the character is occurring in the cursor window during the actual entry of the character keystrokes by the operator. At the same time, the syntax checking is taking place in front of the operator. What this provides to the user is an actual view of the character as it is being developed with syntax errors being caught during the process of the character construction. In earlier attempts to solve this problem, the character was either built and then displayed or was built and displayed in pieces, with the syntax check occurring after the character had been completely entered into the keyboard.

Figure 11:
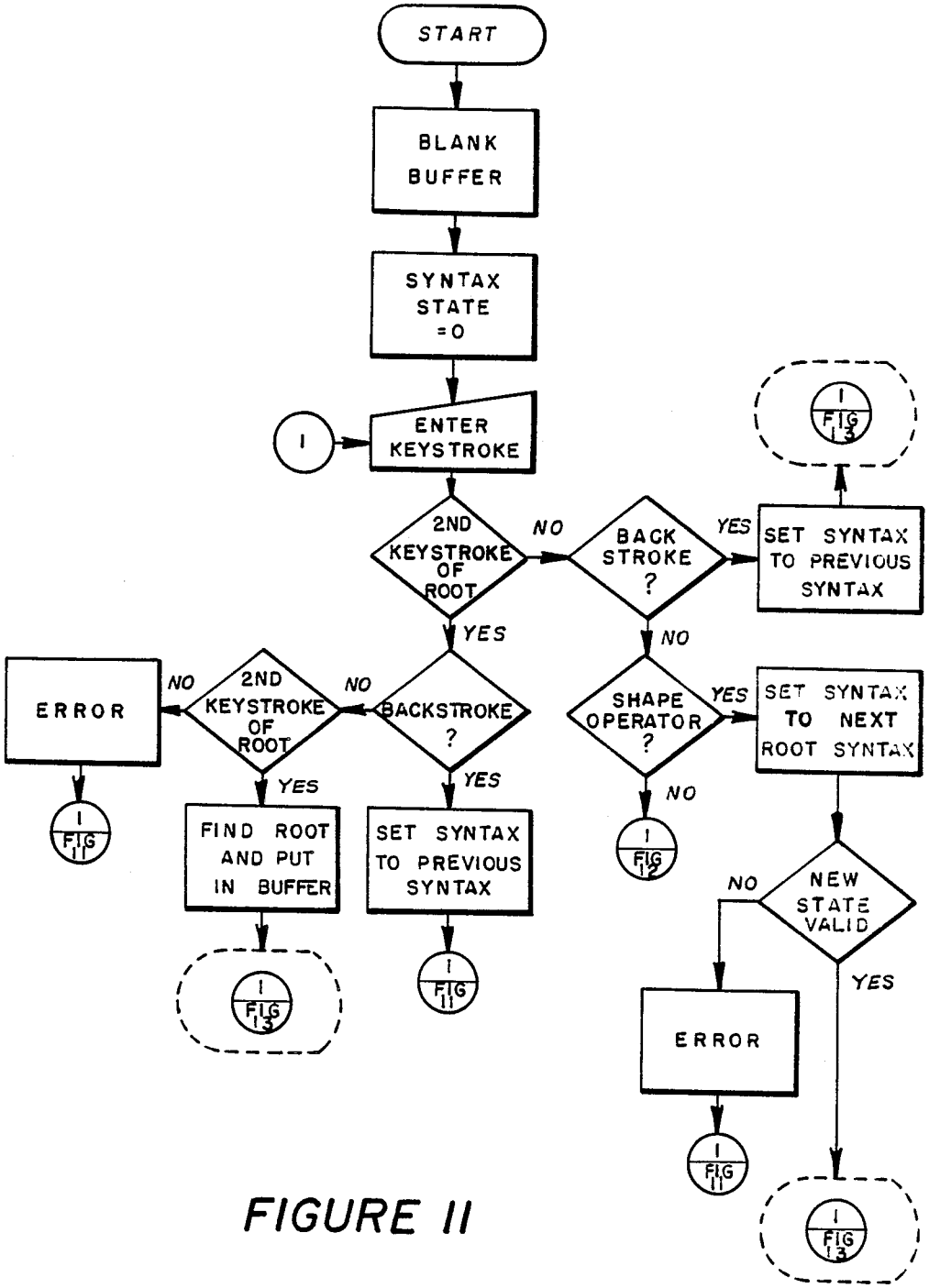
FIGS. 11 and 12 are flow charts of the "build mode" utilized in this system.
Figure 12:
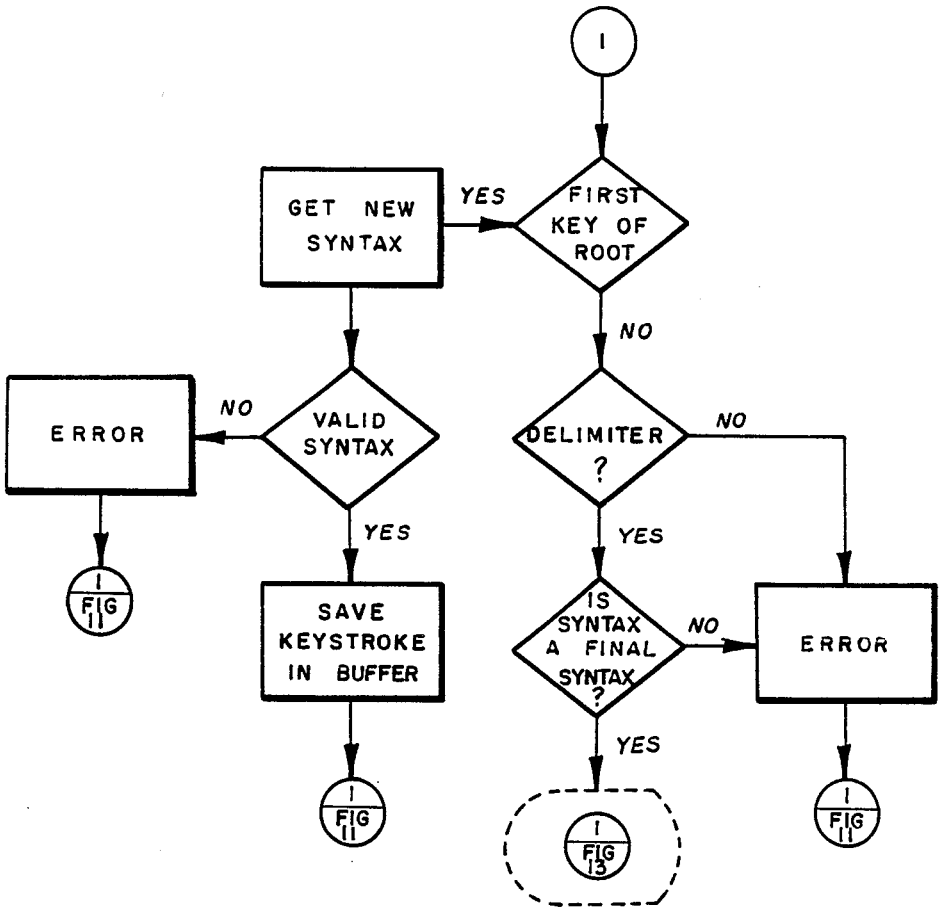
Figure 13:
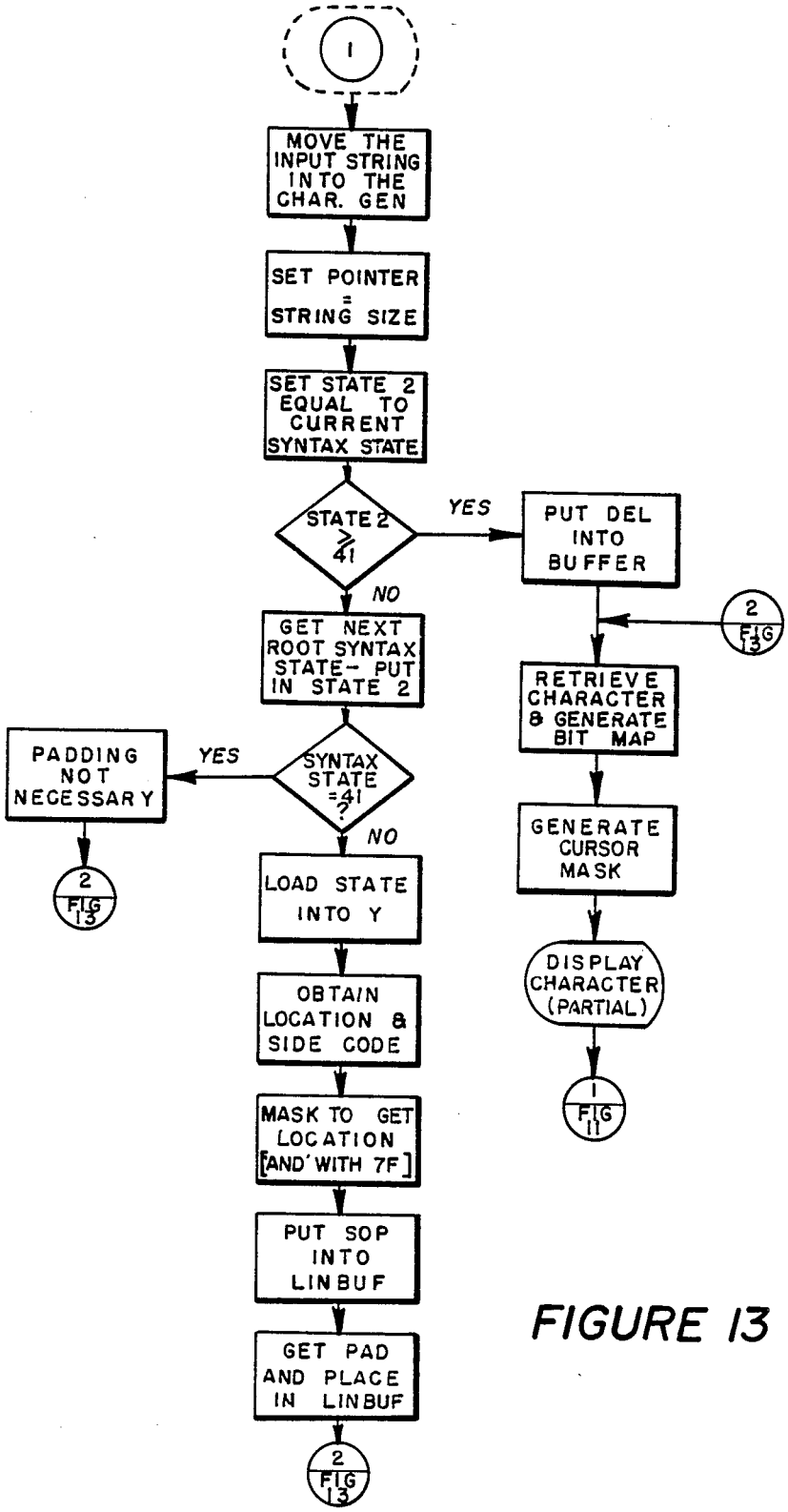
FIG. 13 is a flow chart of the "build character" phase of this invention.

FIGS. 11 and 12 are flowcharts of a program that may be used in the actual construction of characters. FIG. 13 is the procedure for "padding" the cursor window during the construction of the character so that it will flash or blink in the operative position. It is to be understood that certain supervisor programs for the display of characters on a cathode ray tube or the like are not included with this invention as such programs are well known in the art and need not be further described. Further, compressing of ideographic characters is not further described in this specification since such a capability is fully described in the previously-mentioned U.S. Pat. No. 4,408,199 and such material as is contained in that patent is incorporated herein by reference.

It is to be assumed at this point that a supervisory program has set up the display tube so that the cursor window is present in the lower left-hand corner and that the various buffers have been cleared of previous characters. Reference to FIG. 11 will show that the syntax state has been set at state 0 at the beginning of the entry of a character string, which corresponds to the beginning node on the state tree illustrated in FIG. 10. Once the operator enters a keystroke, the computer program will check to see if that keystroke is a root, and in particular, if it is the second keystroke of a root. This is accomplished by the means of a flag or bit that may be set if the program senses that the first character of a data string is greater than a hexidecimal B7 (see FIG. 9). If the entered keystroke is not greater than B7, the program will check to see if a backstroke has been entered into the keyboard. Of course, it is understood that in the first pass through, the backstroke would be superfluous. However, the syntax state would nevertheless be reset to 0, which was the state at the beginning of the program. In the event the first keystroke is not a backstroke, the program will check to see if it is a shape operator. If the program finds a shape operator (in this application a character string greater than or equal to A9 and less than or equal to hexidecimal B7), the program will look ahead to find the next root syntax state. On the first pass, this would either be state 15 following a paired shape operation, or state 33 following a tripled shape operation. If, for some reason, the new state is found to be invalid, an error flag is raised and the new state is not accepted, thus turning the program to position 1 in FIG. 11. If the new state is valid, the program then shifts to built that material in the form of a character in the cursor window of the video display tube.

Reference should now be made to FIG. 13, wherein the input string is moved into the character generator so that the individual sets of data (shape operators and root ideograms) may be looked at. Referring specifically to FIG. 5, the initial state would be equal to zero until the character string AE (a shape operator) is keyed in. When this occurs, the program first determines that a paired shape operator has been entered and the character generator is set to state 1 (see FIG. 10). Looking for the next root state in the state tree shown in FIG. 10, the program will determine that 15 is the next root state. If, on the other hand, a single root had been entered at this point, the state would be equal to 41 and no shape operation would be necessary so that the program could then move the character to the display area of the screen as indicated in FIG. 1. However, in this instance, the initial shape operator of AE has been entered and the program must divide the screen as shown in FIG. 5.

It is necessary for the driving program to "understand" which portion of the cursor window should be blinking and which should be steady. In order to accomplish this, the underlying program displays the character and the unused portions in a steady state and overlays the blinking portion. thus, at time T1 in FIG. 5, the entire cursor except for that blanked area across the center of the cursor to show the separation, is steady. Overlaid on top of the steady portion and character is a blinking cursor in the lower half. The resulting view to the operator is a blinking upper portion and a steady state lower portion.

In order to accomplish this blinking, the program must determine where in the data string it is located. For example, at time T1 in FIG. 5 when only the shape operator AE has been entered and it has been determined that the program is not looking at a final state, then what has been denoted in FIG. 13 as a location and side code is used to find where in the data string (location) the program is looking at that particular time and whether it is looking at the right (upper) or left (lower) portion [side] of the cursor window. At time T1, the program is looking at the upper portion of the cursor window. However, initially a "pad" is developed and placed in the line buffer for the entire cursor window. At that point, the program will retrieve the character that has been entered (in this case, no character has been entered) and generate the overlying cursor mask which causes the lower portion of the screen to be illuminated at all times as indicated at time T1. At time T2 in FIG. 5, the characters C2C2 are entered and the same step through is made on the flow charts at FIG. 11 and 12, except this time a root keystroke is entered, specifically, the hexidecimal C2. Thus, in FIG. 11, when the check for a shape operator indicates that the entered hexidecimal figure is not a shape operator, the program will determine whether it is the first key of the root or a delimiter (the end of the character string in), and take the appropriate action. If it is the first key of a root, then the program will look for the new syntax state, save the keystroke in the buffer, and set the "second keystroke of a root" flag so that in returning to point 1 on FIG. 11, the second hexidecimal C2 when entered at the keyboard will then be determined to be the second keystroke of the root, in which case the program will find the root in the appropriate table stored in the microprocessor and place that root in the buffer, passing on to the flow chart in FIG. 13.

Here again, the character string will be moved in the input string with the entire cursor window being padded and the character being placed in the appropriate position, namely, the upper portion of the cursor window as shown at time T2 in FIG. 5. This is indicated at FIG. 13 in the block labelled "Display Character (Partial)". At this time, the program again returns to the flow chart in FIG. 11 to pick up the next string of data, namely, the shape operator B5 which divides the lower half of the screen or cursor window into two portions with the left portion blinking. As noted above, a second character C2C2 is then entered in this left-hand portion, following the steps shown in the flow chart and finally the same character for "tree" is placed at the right-hand side of the lower part of the screen, as indicated in FIG. 5.

It was previously noted that the program must determine the location of the program as it cycles through the various steps noted above. It can be seen in FIG. 5 and in the other figures corresponding to FIG. 5 that each hexidecimal eight-bit byte, namely, AE, C2, C2, B5, etc. has positioned beneath it a digit, namely, zero, 1, 2, 3, and so forth. Thus, the location at time T3 corresponds to three while the location at T4 corresponds to four and five. Knowing the location in the data string and the size of the cursor that the program is operating on, an appropriate pad can be retrieved and placed in the buffer from a pad table. It has been found that seven pads are sufficient for the present program. One of these seven pads is a blank pad, one of them being a door-like pad as similar to the outer portion of the shape operator AD, and a third pad being a similar to the inner portion of the shape operator AD. The remaining pads are variations on the entire cursor and may be compressed or expanded as the case may require depending upon whether the cursor window is divided horizontally, vertically, either in half, or in three parts.

Once the character is completed as shown at time T5 in FIG. 5 and the user is satisfied that the character is the composite ideographic character in the form in which he wishes, the delimiter is added to the character string. The delimiter may be a space bar indication on a conventional keyboard, or some special character. At that time, the character is moved to its final position, in this embodiment the movement is upwardly on the screen as shown in FIG. 1 to appear as the single character "tree" appears in the upper left-hand corner of the screen. Other expositions of the developed characters may also occur. For example, the character may be shifted directly to a printer or, if the system is being used to communicate with another remote site, the character may be sent out as a code string to the remote site.

Reference has been made to the hexidecimal code structure used to represent the root characters. It should be noted that the Japanese industrial standard, which associates a coding structure with about three thousand different characters, may be converted to a hexidecimal representation. This or a similar coding structure may be utilized in place of the coding structure used above to represent the various root characters.

OPERATION OF THE PREFERRED EMBODIMENT

It should be apparent to those skilled in the art how the preferred embodiment operates. However, the following comments are offered for further clarification.

The user would be provided with a rather conventional computer which may be as small as a microcomputer such as an Apple II made by Apple Computer Inc. in Cupertino, Calif. Memory size is dependent upon the size of the ideographic character set that is to be utilized in the computer and thus, no specification on memory size will be provided. It is further assumed that the graphic display system is conventional and provides control over each pixel on the screen so that dot matrices may be utilized to generate characters on the surface of the cathode ray tubes assumed to be present with the microcomputer. Again, the dot matrix size may vary. However, in one application, a twenty-one by twenty-one dot matrix was found appropriate to generate an ideographic character set having sufficient intelligence to include upwards of four or five root characters without loss of intelligence in the root characters.

The present program takes the inputted data string and displays simultaneously on the screen in the cursor window placing the root characters as they are keyed in by the user along with appropriate shape operators used to position and reduce the size of the root characters as appropriate. Should a root character alone be selected as the initial keystroke, that character is displayed in the cursor window in its full size and the next character would be a delimiter to indicate that the correct character has been selected. When the delimiter occurs, the character is moved upward on the screen, as indicated in FIG. 1, blinking the cursor located in the lower left portion of the screen until the insertion of the next character, be it a single root or a composite character. If the next character is a composite character, the various roots are preceded by a shape operator which then divides the cursor appropriately, as indicated above, with the next appropriate portion of the cursor blinking or flashing to indicate where the next operation will take place. A blinking or flashing of the cursor occurs as noted above in a top down, left to right, outside to inside sequence. As the operator keys in the various code strings representing either shape operators or individual roots, the composite character is built on the screen a piece at a time until the entire cursor is filled up with characters, at which time the delimiter is entered and the character is moved to the upper portion of the screen as noted above.

This invention, which provides a simultaneous display of a character being constructed in an ideographic character set, is limited only by the appended claims.

I claim:

1. In a computer display system having a processor, an input device, a visual display tube, and a memory, the memory having an ordered set of ideograms stored therein, and means for constructing composite ideograms in identically dimensioned ideogram spaces, a method of displaying a composite ideogram in one of said identically dimensioned ideogram spaces comprising the steps of:

(a) accepting a series of codes each being one of (i) an ideogram code, (ii) a shape operator code;

(b) highlighting on the display tube in an order predetermined by the last received shape operator code the next operable area within the same one of the identically dimensioned ideograms spaces in which an operation may occur and displaying, after accepting each ideogram code, the intermediate structure of the composite ideogram in the operable area of the same one of the identically dimensioned ideogram spaces;

(c) repeating steps (a) and (b) as each code is accepted until a composite ideogram is constructed in the one of the identically dimensioned ideograms spaces.

2. A visual display system for use with an ideogram generator wherein each generated ideogram is composed of one or more components and further wherein at least some generated ideograms are composed of more than one reduced size juxtaposed components each forming a segment and the whole occupying the same area as an ideogram of a single component, the system comprising:

an output device capable of displaying a composite ideogram in an "n×m" dot matrix:

processor means for operating said output device;

input means for receiving the sequence of coded signals, each sequence being one of (i) a component of the generated ideogram (ii) a direction to reduce the size of a component;

program control means responsive to said coded signals for checking the syntax of said coded signals as the signals are received and for directing the processor means to display the components of the compound ideogram once correct syntax is found and as the components are received , said program control means further for highlighting on the output device in an order predetermined by the last received direction to reduce the size of the component the next operable area within the "n×m" dot matrix.

3. The display system of claim 2 wherein said program control means includes error checking means causing a warning that is to be displayed and for returning the program control means to the last correct syntax.

4. The display system of claim 3 wherein the program control means includes syntax check means for ensuring a proper data string has been entered.

5. A visual display system for use with an ideographic language where each character of the language is formed of one or more root ideograms and further wherein each composite character occupies the same "n×m" pixel space as a single root ideogram with each root ideogram being reduced in size to an "r×s" pixel area smaller than "n×m" by one of the several shape operators and further wherein a composite character has at least one shape operator and at least two ideograms, the display system comprising:

an input device for accepting a series of coded strings of root ideograms and shape operators;

means for determining whether each of the inputed series represents a root ideogram or a shape operator; and means for displaying in the "r×s" pixel area the root ideograms as they are accepted by the input device and after being reduced in size by the shape operator.

6. The display system of claim 5 further including means for further highlighting at least a portion of the "n−r" by "m−s" space indicating the next operable area within the "n×m" matrix.

* * * * *